US009889328B2

(12) United States Patent
Dai et al.

(10) Patent No.: US 9,889,328 B2
(45) Date of Patent: Feb. 13, 2018

(54) CONNECTING STRUCTURE BETWEEN TRAMPOLINE BED AND FRAME, AND TRAMPOLINE AND CONNECTING PIECE USING SAME

(71) Applicant: Xiaoping Tang, Ningbo (CN)

(72) Inventors: Zhendong Dai, Ningbo (CN); Xiaoping Tang, Ningbo (CN)

(73) Assignee: Xiaoping Tang, Ningbo (CN)

( * ) Notice: Subject to any disclaimer, the term of this patent is extended or adjusted under 35 U.S.C. 154(b) by 74 days.

(21) Appl. No.: 15/100,524

(22) PCT Filed: Jul. 17, 2014

(86) PCT No.: PCT/CN2014/000678
§ 371 (c)(1),
(2) Date: May 31, 2016

(87) PCT Pub. No.: WO2015/085646
PCT Pub. Date: Jun. 18, 2015

(65) Prior Publication Data

US 2016/0296782 A1 Oct. 13, 2016

(30) Foreign Application Priority Data

Jul. 17, 2014 (CN) ..... 2013 2 0813394 U

(51) Int. Cl.
*A63B 5/11* (2006.01)
*A63B 21/055* (2006.01)

(52) U.S. Cl.
CPC ..... *A63B 5/11* (2013.01); *A63B 21/0557* (2013.01); *A63B 21/0552* (2013.01); *A63B 2225/09* (2013.01)

(58) Field of Classification Search
CPC ..... A63B 21/00; A63B 5/11; A63B 21/0557; A63B 2225/09; A63B 21/0552
USPC ..... 482/27, 28
See application file for complete search history.

(56) References Cited

U.S. PATENT DOCUMENTS

| | | | | | |
|---|---|---|---|---|---|
| 2,916,746 | A * | 12/1959 | Pease | A63B 5/11 | 182/139 |
| 3,891,208 | A * | 6/1975 | Sidlinger | A63B 5/11 | 482/27 |
| 3,983,585 | A * | 10/1976 | Sidlinger | A63B 5/11 | 182/139 |
| 6,129,649 | A * | 10/2000 | Yang | A63B 5/11 | 482/27 |
| 2006/0116242 | A1* | 6/2006 | Publicover | A63B 5/11 | 482/27 |
| 2010/0009812 | A1* | 1/2010 | Pieper Genannt Schmauck | A63B 5/11 | 482/27 |
| 2013/0316876 | A1* | 11/2013 | Publicover | A63B 5/11 | 482/27 |

* cited by examiner

*Primary Examiner* — Sundhara Ganesan
(74) *Attorney, Agent, or Firm* — Wang Law Firm, Inc.

(57) ABSTRACT

A connecting structure between a jumping mat and a frame in a trampoline, comprises an elastic element connected to the frame, the elastic element having at least one positioning element; and a connecting element connected to the jumping mat, the connecting element having at least one limiting element for engaging one of the plurality of positioning elements and thus connecting the elastic element to the connecting element. A trampoline using the connecting structure is also disclosed.

8 Claims, 10 Drawing Sheets

CONNECTING STRUCTURE BETWEEN TRAMPOLINE BED AND FRAME, AND TRAMPOLINE AND CONNECTING PIECE USING SAME

RELATE APPLICATIONS

This application is a national phase entrance of and claims benefit to PCT Application for a connecting structure between a jumping mat and a frame in a trampoline, and a trampoline and a connecting element in a trampoline, PCT/CN2014/000678, filed on Jul. 17, 2014, which claims benefit to Chinese Patent Application 201320813394.3, filed on Dec. 10, 2013. The specifications of both applications are incorporated here by this reference.

FIELD OF THE INVENTION

The present invention relates to the technical field of a trampoline, and in particular to a connecting structure between a jumping mat and a frame in a trampoline, and a trampoline using the connecting structure and a connecting element in a trampoline.

DESCRIPTION OF THE PRIOR ART

At present, a trampoline in the market mainly includes a jumping mat, a frame, and a connecting element for connecting the jumping mat and the frame. Most existing connecting elements are springs. Most springs used in the trampolines are metal springs. If the used spring is too soft, on one hand, the elasticity is low and it is likely to have deformation; and on the other hand, the overall elasticity of the trampoline is influenced, and the spring is likely to be damaged in long-term use so that the normal use of the trampoline is influenced; and if the used spring is too hard, no wide elasticity can be generated. Furthermore, the metal springs are likely to be eroded and deformed, and easily cause damage to users, and so on. In contrast, an elastic rope can alleviate and eliminate the above disadvantages, easing the jumping of users. A Chinese Patent CN201123975Y, titled "Trampoline with Improved Connecting Structure of Trampoline Bed", disclosed a connecting element combined by an elastic rope and a hanger, wherein hangers are respectively fixed or movably connected to two ends of the elastic rope; and when in use, the hanger at one end of the elastic rope is hung on a pendent seamed on the periphery of the jumping mat and the hanger at the other end of the elastic rope is connected to the trampoline frame. With such a structure, the connecting element is safe in use, and the disadvantages such as easy pinching caused by a spring connecting element are eliminated. However, the connecting structure mentioned above is unable to adjust the degree of tension of an elastic element between the jumping mat and the frame, since the jumping mat of the trampoline itself generally has no elasticity. As a result, when users of the trampoline have different weights, the vertical pressures applied to the whole trampoline jumping mat surface by different users will be different, so that the stress shared by each elastic rope will also be different. Accordingly, different degree of tension or relaxation will be generated. For users, the most intuitive feeling is that different jumping senses will be generated by using a same trampoline.

SUMMARY OF THE INVENTION

Based on the above stated prior art, a first technical problem to be solved by the present invention is to provide a new connecting structure between a jumping mat and a frame in a trampoline, which is safe in use and convenient and firm in mounting, and can adjust the degree of tension of an elastic element between the jumping mat and the frame according to different weight ranges and levels of different users.

A second technical problem to be solved by the present invention is to provide a trampoline using the above connecting structure between a jumping mat and a frame in a trampoline.

To solve the first technical problem, the connecting structure between a jumping mat and a frame in a trampoline, comprises an elastic element connected to the frame, the elastic element having at least one positioning element; and a connecting element connected to the jumping mat, the connecting element having at least one limiting element for engaging one of the plurality of positioning elements and thus connecting the elastic element to the connecting element; wherein if there is one positioning element and there are multiple limiting elements, the limiting elements are disposed apart from each other along a length direction of the connecting element; wherein if there are multiple positioning elements and there is one limiting element, the positioning elements are disposed apart from each other along a length direction of the elastic element. Therefore, by switching the connection between a positioning element and a different limiting element, the degree of tension of the elastic element can be adjusted, so that the elastic force of connection between the jumping mat and the frame is adjusted; or by switching the connection between a limiting element and a different positioning element, the degree of tension of the elastic element also can be adjusted, so that the elastic force of connection between the jumping mat and the frame is adjusted.

The elastic element of the present invention can be an elastic rope, or a flat elastic band having a certain width; the connecting element can be a positioning box having an opening on the top and a hollow interior, a hook, a hanger having a similar shape to that of the hook, or a connecting belt.

Preferably, for one hand of the present invention, the elastic element is an elastic rope, the positioning element is a bead fixed onto the elastic rope and has a diameter greater than a diameter of the elastic rope; and the bead can be spherical, or be prismatic, cylindrical or in other shapes, as long as the external diameter thereof is greater than the diameter of the elastic rope.

When the elastic rope is designed as the elastic element and the bead is designed as the positioning element, preferably, the connecting element can be a positioning box with a hollow chamber; at least one limiting hole for the elastic rope to pass through is provided on a front side of the positioning box, and the diameter of the limiting hole is less than a diameter of the bead; and the hollow chamber and the limiting hole of the positioning box form the limiting element. In addition, in order to prevent the bead from falling out of the positioning box, a lid can be additionally provided on the positioning box; and the lid is rotatably connected to one side of the positioning box through a rotating shaft, and the other side thereof can be positioned and engaged through a slot. Limiting and disposing a different bead in the positioning box can adjust the degree of tension of the elastic element.

When the elastic rope is designed as the elastic element and the bead is designed as the positioning element, preferably, the connecting element can also be a hook with at least two hook teeth arranged side by side; a distance between two adjacent hook teeth is less than the diameter of the bead, two adjacent hook teeth position the bead and form the limiting element of the connecting element. Likewise, in order to prevent the bead from falling out of the positioning box, a cap which can be covered on the hook teeth can be movably connected to the hook, and a groove or hole into which the hook teeth are clasped is provided on the bottom of the cap. Limiting and hooking a different bead in the hook teeth of the hook can adjust the degree of tension of the elastic element.

When the elastic rope is designed as the elastic element and the bead is designed as the positioning element, preferably, the connecting portion also can have the following structure: the connecting element has a recess for receiving the bead, and the recess has an opening for the elastic rope to pass through, a diameter of the opening is less than a diameter of the bead so as to position the bead, the recess and the corresponding opening form the limiting element.

Preferably, there are multiple pairs of recesses and corresponding openings on the connecting element, and these pairs of recesses and openings form the limiting element.

Preferably, the connecting element is in symmetrical along a center axis, there are multiple pairs of recesses and corresponding openings on the connecting element, one pair or multiple pairs of recesses and corresponding openings distributed on both sides of the center axis on the connecting element, and these pairs of recesses and openings form the limiting element.

Preferably, for the another hand of the present invention, the elastic element is a flat elastic band having a width, and the elastic band has at least one positioning hole as the positioning element. There can be multiple positioning holes provided on the elastic band in a same row between edges of the elastic band, in order to strengthen the fastness and stability of the connection. In this case, the connecting element can be a hanger having multiple hanger teeth, each hanger tooth engages a corresponding positioning hole, the hanger teeth form the limiting element of the connecting element. Hanging the hanger teeth in a positioning hole with a different position can adjust the degree of tension of the elastic element.

Preferably, for one more hand of the present invention, the connecting element is a connecting belt, which has multiple through slots spaced apart along a length direction of the connecting belt, the multiple through holes form the limiting element of the connecting element. In this case, the elastic element can be an elastic rope or also can be an elastic band, and the positioning element on the elastic element is a pulling hook which is provided on a tail end of the elastic element. Hanging the pulling hook in a perforation in a different position can adjust the degree of tension of the elastic element.

Of course, in order to achieve the purpose of adjustable degree of tension of the elastic element, the connecting element can also be a plurality of hanging rings with different inner diameters, which can be square or round or triangular. In this case, the elastic element also can an elastic rope or also can be an elastic band, and the positioning element on the elastic element can be a pulling hook which is provided on a tail end of the elastic element; and the pulling hook can be hung on the hanging ring. Hanging the pulling hook in a different hanging ring can adjust the degree of tension of the elastic element.

To solve the second technical problem mentioned above, the trampoline comprises a frame, an elastic element connected to the frame, a jumping mat, and a connecting element connected to the jumping mat, wherein, the elastic element has a plurality of positioning element disposed apart from each other along a length direction of the elastic element; the connecting element has a plurality of limiting element disposed apart from each other along a length direction of the connecting element, for engaging one of the plurality of the positioning element and thus connecting the elastic element to the connecting element; one end of the elastic element is connected to the frame, and other end of the elastic element is connected to the limiting element on the connecting element through the positioning element; or a middle part of the elastic element wraps around the frame, and two ends of the elastic element are connected to the limiting element on the connecting element through the positioning element.

Compared with the prior art, in the present invention, since the connection between the jumping mat and the frame is realized by the coordination of the elastic element and the connecting element, and the limiting element and the positioning element which can be coordinated and positioned with each other are respectively provided on the elastic element and the connecting element, the problem of easy pinching caused by connecting the jumping mat and the frame by a spring is overcome; meanwhile, by adjusting the connection between a positioning element and a different limiting element, the degree of tension of the elastic element can be adjusted, so that the elastic force of connection between the jumping mat and the frame is adjusted. A trampoline of such a structure is safe in use and convenient and firm in mounting, and can adjust the practical length of the elastic element according to different weight ranges and levels of different users, so that one trampoline can serve for different users and all users can maximally obtain the desired comfort and jumping sense.

BRIEF DESCRIPTION OF THE DRAWINGS

FIG. 9-1 is a perspective view of a portion of a trampoline according to a first embodiment of the present invention, using the connecting structure of the first embodiment;

FIG. 9-2 is a perspective view of a portion of a trampoline according to a second embodiment of the present invention, using the connecting structure of the third embodiment;

FIG. 9-3 is a perspective view of a portion of a trampoline according to a third embodiment of the present invention, using the connecting structure of the fifth embodiment;

FIG. 9-4 is a perspective view of a portion of a trampoline according to a fourth embodiment of the present invention, using the connecting structure of the sixth embodiment;

FIG. 10-1 is a perspective view of a portion of a trampoline according to a fifth embodiment of the present invention, using the connecting structure of the fourth embodiment;

FIG. 10-2 is a perspective view of a portion of a trampoline according to a sixth embodiment of the present invention, using the connecting structure of the second embodiment;

FIG. 10-3 is a perspective view of a portion of a trampoline according to a seventh embodiment of the present invention, using the connecting structure of the fifth embodiment;

FIG. 10-4 is a perspective view of a portion of a trampoline according to a eighth embodiment of the present invention, using the connecting structure of the sixth embodiment;

FIG. 10-5 is a perspective view of a portion of a trampoline according to a ninth embodiment of the present invention, using the connecting structure of the fourth embodiment;

DETAILED DESCRIPTION OF THE PREFERRED EMBODIMENT

To enable a further understanding of the present invention content of the invention herein, refer to the detailed description of the invention and the accompanying drawings below:

A connecting structure between a jumping mat and a frame in a trampoline provided by the present invention, comprises an elastic element connected to the frame, the elastic element having a plurality of positioning element disposed apart from each other along a length direction of the elastic element; and a connecting element connected to the jumping mat, the connecting element having has a plurality of limiting element disposed apart from each other along a length direction of the connecting element and thus connecting the elastic element to the connecting element. The present invention will be further described as below by the following several embodiments.

Figure 1:
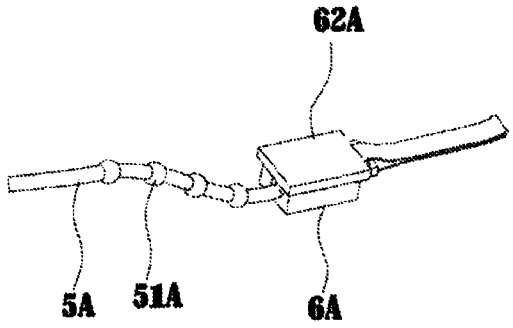
FIG. 1 is a perspective view of a connecting structure according to a first embodiment of the present invention.
Figure 2:
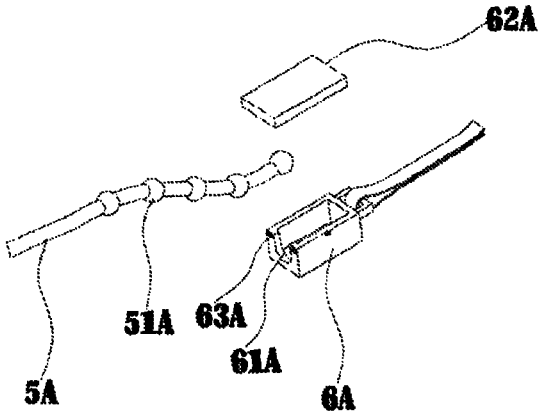
FIG. 2 is an exploded view of FIG. 1.

Embodiment 1 of the connecting structure:

FIG. 1 and FIG. 2 show a first embodiment of the connecting structure. In this embodiment, the elastic element is an elastic rope 5A, the positioning element is a bead 51A fixed onto the elastic rope 5A and has a diameter greater than a diameter of the elastic rope 5A; and the bead 51A can be spherical, or can be prismatic, cylindrical or in other shapes; the connecting element is a positioning box 6A with a hollow chamber; at least one limiting hole 61A for the elastic rope to pass through is provided on a front side of the positioning box 6A, and a diameter of the limiting hole 61A is less than a diameter of the bead 51A, so that the bead 51A is clamped in the positioning box 6A without slipping off; and the hollow chamber and the limiting hole 61A of the positioning box form the limiting element.

The positioning box 6A also comprises an upper end lid 62A which can be covered on an upper end face of the positioning box 6A, and a plurality of snaps are respectively provided on the circumference of an inner edge of the upper end lid 62A. Accordingly, an engagement slot 63A into which the snaps are engaged is provided on the positioning box 6A, so that the upper end lid 62A is covered on the upper end face of the positioning box 6A, or in order to prevent the bead 51A from popping out of the upper end face of the positioning box 6A.

When in use, firstly, clamp the bead 51A on the elastic rope 5A into the positioning box 6A and stretch the elastic rope 5A out from the limiting hole 61A, and then cover the upper end lid 62A of the positioning box 6A is on the upper end face of the positioning box 6A through the coordination of the snaps and the engagement slot 63A. In this way, the elastic rope 5A can be connected to the positioning box 6A, so that the trampoline frame connected to the elastic rope 5A is connected to the jumping mat connected to the positioning box 6A. The degree of tension of the elastic element can be adjusted by adjusting the location of the bead 51A.

Figure 3:
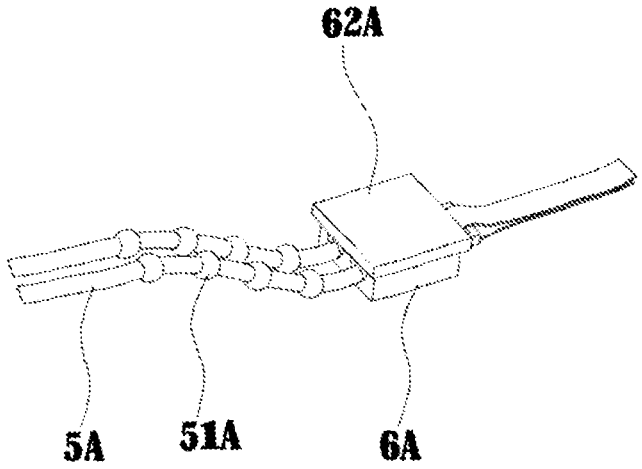
FIG. 3 is a perspective view of a connecting structure according to a second embodiment of the present invention.

Embodiment 2 of the connecting structure:

The difference of this embodiment from Embodiment 1 only lies in that: two limiting holes 61A for the elastic rope to pass through is provided on a front side of the positioning box 6A, as shown in FIG. 3.

Figure 4:
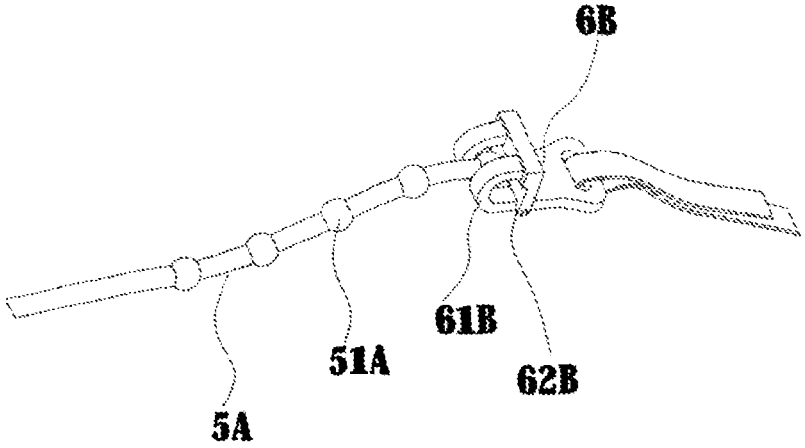
FIG. 4 is a perspective view of a connecting structure according to a third embodiment of the present invention.
Figure 5:
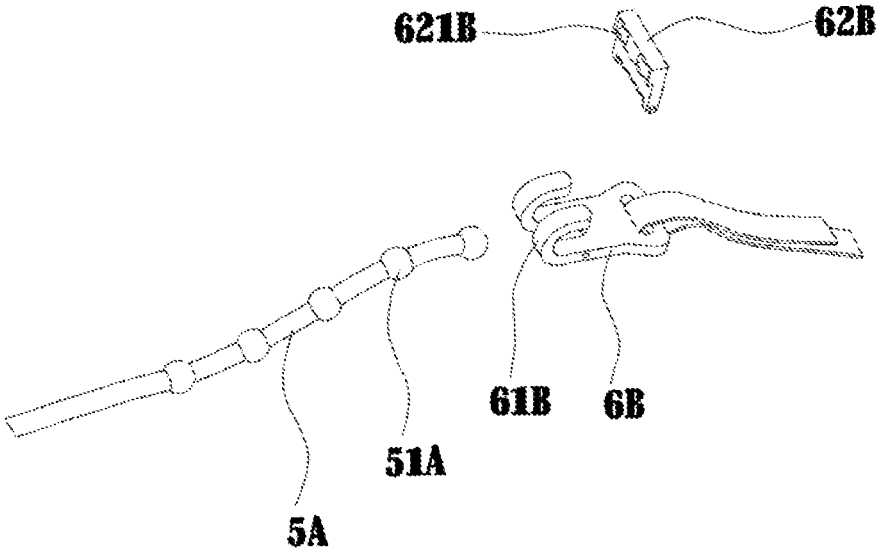
FIG. 5 is an exploded view of FIG. 4.

Embodiment 3 of the connecting structure:

The difference of this embodiment from Embodiment 1 lies in that: as shown in FIG. 4 and FIG. 5, the connecting element is a hook 6B with two hook teeth 61B arranged side by side; a distance between two adjacent hook teeth 61B is less than the diameter of the bead MA, two adjacent hook teeth 61B position the bead and form the limiting element of the connecting element A cap 62B which can be covered on the hook teeth 61B is movably connected to the hook 6B, and a groove or a hole 621B into which the hook teeth 61B are clasped is provided on the bottom of the cap 62B.

When in use, firstly, clamp the bead MA on the elastic rope 5A into the space between the adjacent hook teeth 61B, and then clasp an tail end of the hook teeth 61B is into the groove or the hole 621B of the cap 62B. In this way, the elastic rope 5A can be connected to the hook 6B, so that the frame connected to the elastic rope 5A is connected to the jumping mat connected to the hook 6B.

Figure 6:
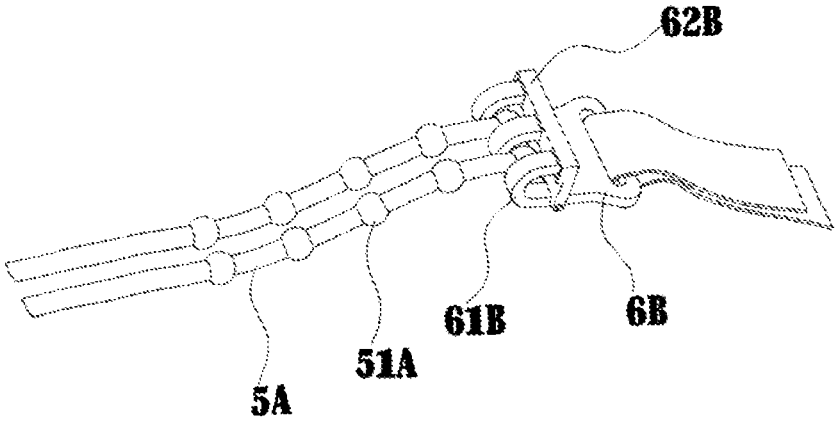
FIG. 6 is a perspective view of a connecting structure according to a fourth embodiment of the present invention.

Embodiment 4 of the connecting structure:

The difference of this embodiment from Embodiment 1 only lies in that: as shown in FIG. 6, the hook 6B has three hook teeth 61B arranged side by side.

Figure 7:
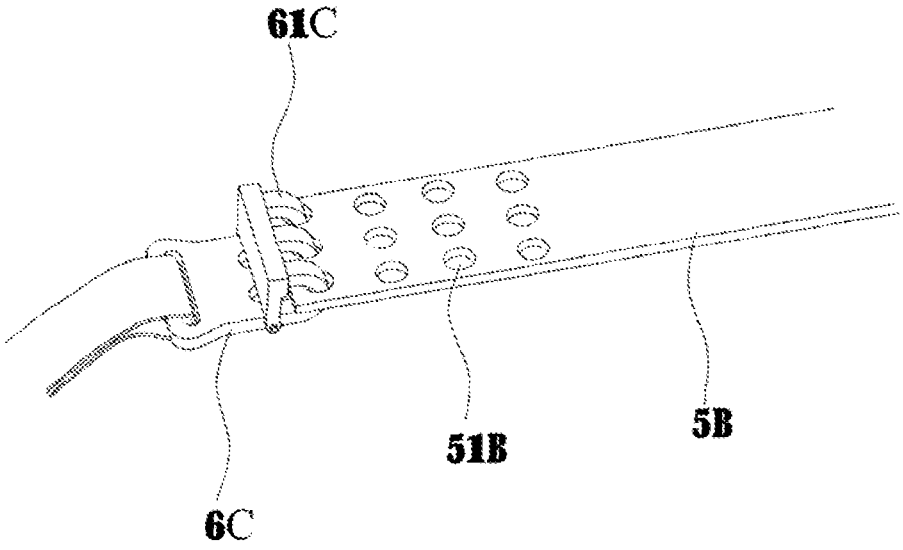
FIG. 7 is a perspective view of a connecting structure according to a fifth embodiment of the present invention.

Embodiment 5 of the connecting structure:

In this embodiment, as shown in FIG. 7, the elastic element is a flat elastic band 5B having a width, and the elastic band 5B has at least one positioning hole 51B as the positioning element. There are multiple positioning holes 51B provided on the elastic band 5B in a same row between edges of the elastic band.

The connecting element is a hanger 6C having multiple hanger teeth 61C, each hanger tooth 61C engages a corresponding positioning hole 51B, the hanger teeth 61C form the limiting element of the connecting element.

When in use, hooking the hanger teeth 61C of the hanger 6C into the positioning hole 51B can realize the connection of the elastic element and the connecting element. In order to prevent the hanger 6C from popping out of the positioning hole 51B, one structure similar to the cap 62B in Embodiment 3 can be buckled on the tail end of hanger teeth 61C.

Figure 8:
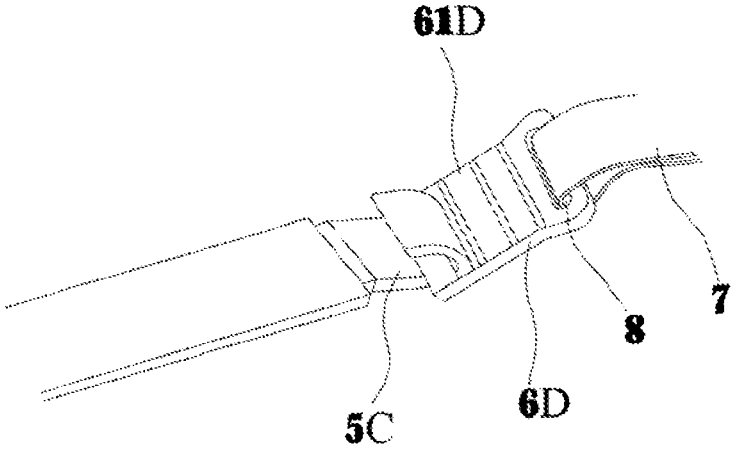
FIG. 8 is a perspective view of a connecting structure according to a sixth embodiment of the present invention.

Embodiment 6 of the connecting structure:

In this embodiment, as shown in FIG. 8, a hole 8, through which a connecting belt 7 provided on an edge of the bed passes, is provided on the connecting element; the connecting element is a connecting belt 6D, and multiple limiting elements are disposed apart from each other along a length direction of the connecting belt 6D; and the limiting element is a through hole 61D on the connecting belt 6D, and the positioning element on the elastic element is a pulling hook 5C which is provided on a tail end of the elastic element.

When in use, hooking the pulling hook 5C into the through hole 61D on the connecting belt 6D can realize the connection of the elastic element and the connecting element.

Figure 11:
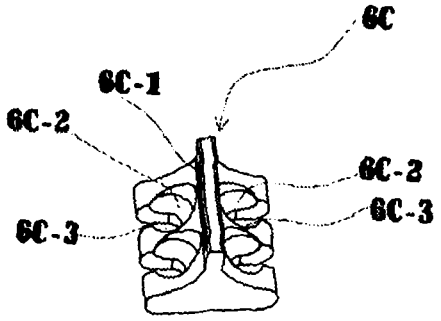
FIG. 11 is a perspective view of a connecting element of the connecting structure according to a seventh embodiment of the present invention.

Embodiment 7 of the connecting structure:

The difference of this embodiment from Embodiment 1 lies in that: as shown in FIG. 11, the connecting element 6C is of a symmetrical structure, and one side has a hole 6C-1 through which the connecting belt provided on an edge of the jumping mat; there are two pairs of accommodating slots 6C-2 and bayonets 6C-3 corresponding thereto provided on two sides of the symmetrical centerline; the accommodating slots 6C-2 are used for clamping the bead 51A, and the bayonets 6C-3 are in communication with the accommodating slots 6C-2 and can allow for the passing of the elastic rope 5; the diameter of the bayonets 6C-3 is less than that of the bead 51A, and four pairs of accommodating slots 6C-2 and bayonets 6C-3 corresponding thereto formed on two side of the symmetry form the limiting element.

Figure 12:
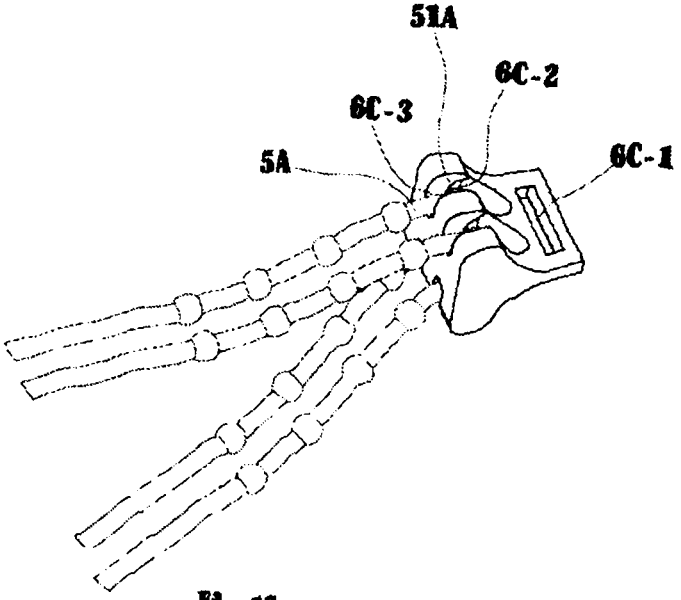
FIG. 12 is a perspective view of a connecting element and an elastic element of the connecting structure according to a seventh embodiment of the present invention.

When in use, the elastic rope 5 is passed through the bayonets 6C-3, and the bead 51A on the elastic rope 5A is clamped into the accommodating slots 6C-2; and the elastic rope 5A can be connected to the connecting element, so that the trampoline frame connected to the elastic rope 5A is connected to the jumping mat connected to the connecting element 6C. In order to increase the connection strength, the connecting element can be connected to two elastic ropes 5A at the same time, as shown in FIG. 12.

Figures 1, 9:
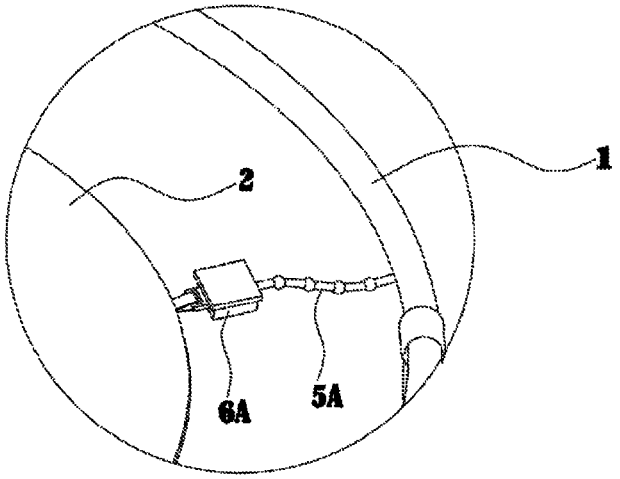
Figures 2, 9:
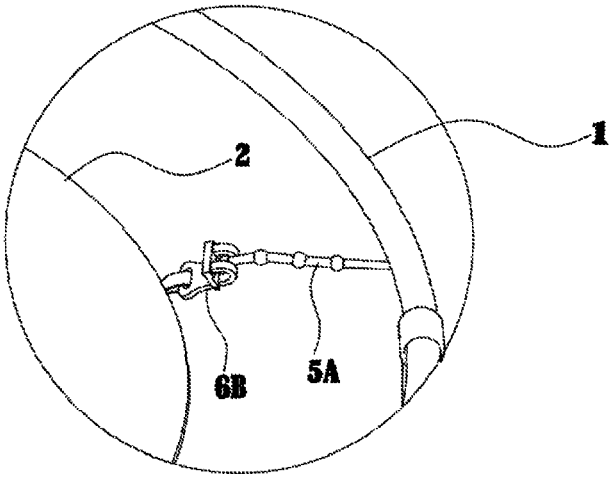
Figures 3, 9:
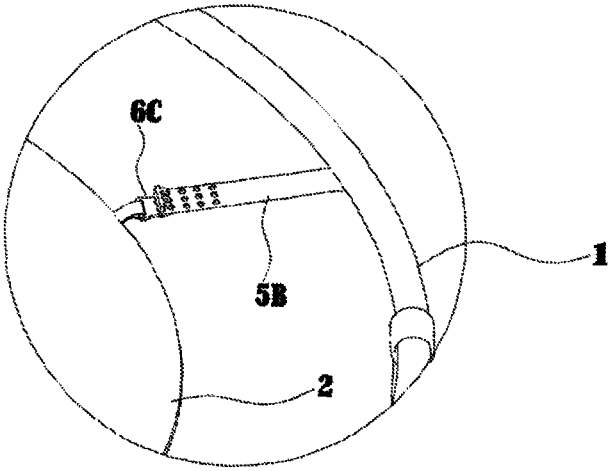
Figures 4, 9:
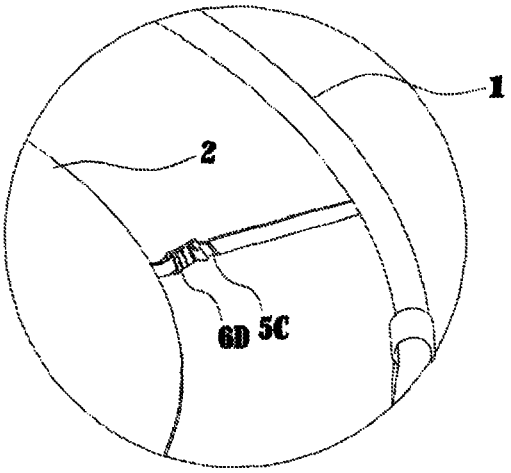

A trampoline is also provided by the present invention. FIG. 9-1 shows a first embodiment of the trampoline, using the connecting structure of the first embodiment. The trampoline comprises a frame 1, an elastic element connected to the frame 1, a jumping mat 2, and a connecting element connected to the jumping mat 2; one end of the elastic element is connected to the frame 1, and a direct-through hole can be provided on the frame; and one end of the elastic element is directly fixed in the direct-through hole, and one end of the connecting element is connected to the jumping mat 2. The connecting structure of Embodiment 1 stated above can be used for connecting the elastic element and the connecting element. In the trampoline, the connecting structure of Embodiment 3 can also be used, as shown in FIG. 9-2. In the trampoline, the connecting structure of Embodiment 5 can also be used, as shown in FIG. 9-3. In the trampoline, the connecting structure of Embodiment 6 can also be used, as shown in FIG. 9-4. Of course, the connecting structures of Embodiments 2, 4 and 5 can also be used for connecting the elastic element and the connecting element.

Figures 1, 10:
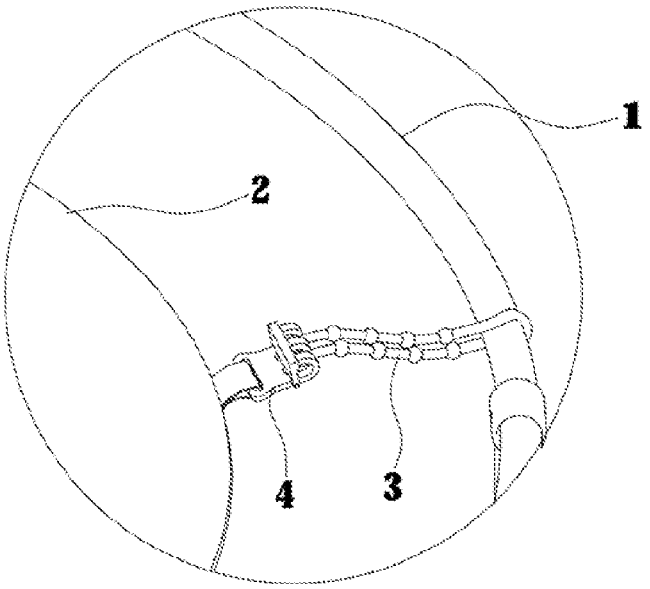
Figures 2, 10:
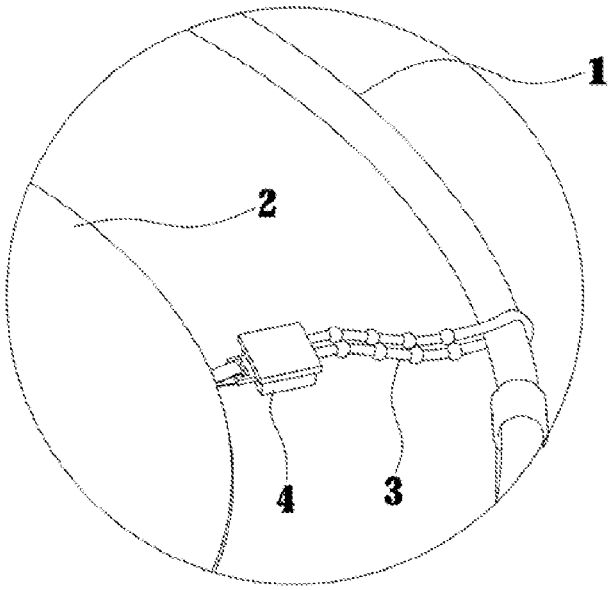
Figures 3, 10:
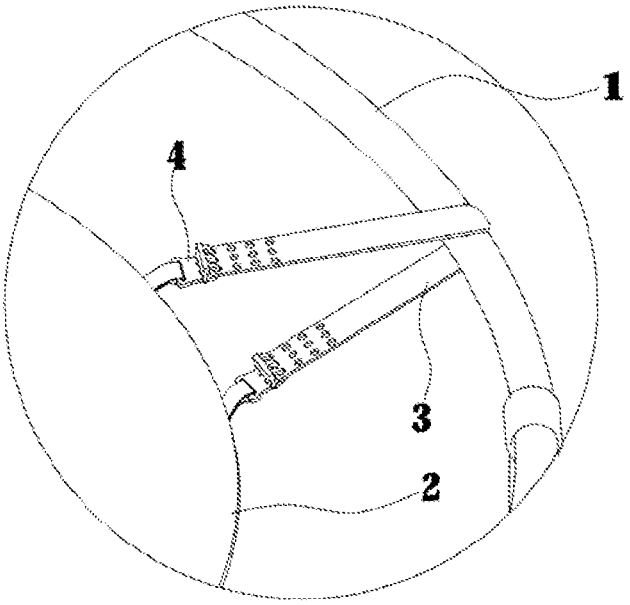
Figures 4, 10:
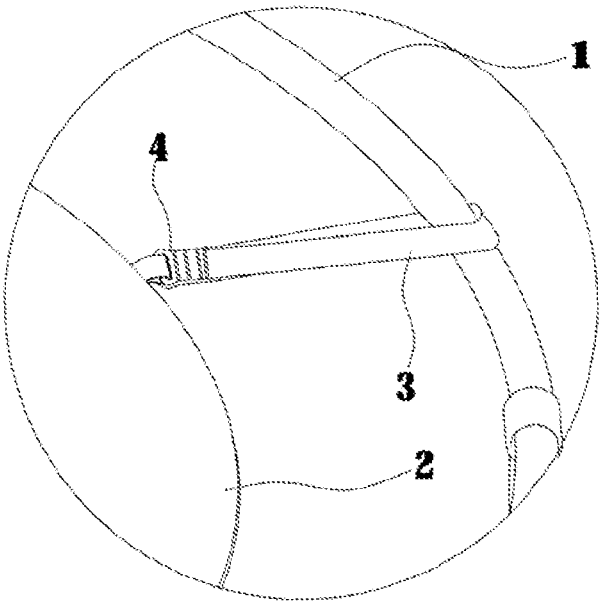
Figures 5, 10:
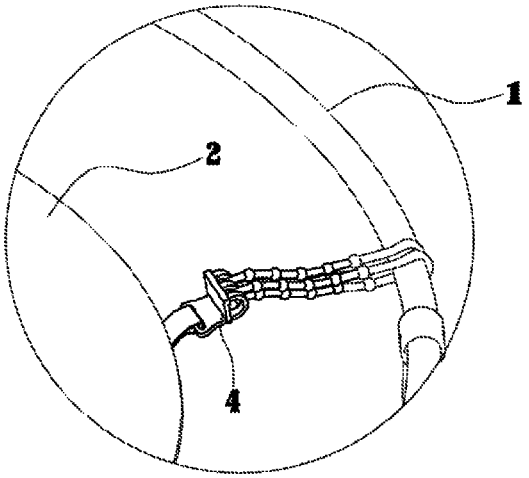

In addition, the middle part of the elastic element can directly wrap around the frame 1, the positioning elements at two ends of the elastic element can be connected to the limiting element on the connecting element in a same manner as in Embodiment 1 to Embodiment 6. For example, the connecting structure of Embodiment 4 can be used for connection, where two ends of a same elastic element can be hung into a same limiting element, as shown in FIG. 10-1, or can be hung into two adjacent limiting elements, as shown in FIG. 10-5. For example, the connecting structure of Embodiment 2 can be used for connection, as shown in FIG. 10-2; the connecting structure of Embodiment 5 can be used for connection, as shown in FIG. 10-3; and the connecting structure of Embodiment 6 can be used for connection, as shown in FIG. 10-4.

The invention claimed is:

1. A connecting structure between a jumping mat and a frame in a trampoline, comprising:

an elastic element connected to the frame, the elastic element having at least one positioning element; and a connecting element connected to the jumping mat, the connecting element having at least one limiting element for engaging at least one positioning element and connecting the elastic element to the connecting element;

the elastic element is an elastic rope, the at least one positioning element is a bead fixed onto the elastic rope and has a diameter greater than a diameter of the elastic rope, the connecting element is a positioning box with an enclosed hollow body, a front side, and an open side; at least one limiting hole for the elastic rope to pass through is provided on the front side of the positioning box, and a diameter of the limiting hole is smaller than a diameter of the bead; and an end lid, having a plurality of snaps provided on a circumference of an inner edge of the end lid, the end lid covering the open side of the enclosed hollow body; and the enclosed hollow body, the end lid, and the at least one limiting hole of the positioning box form the limiting element.

2. The connecting structure of claim 1, wherein there are multiple pairs of recesses and corresponding openings on the connecting element, and these pairs of recesses and openings form the limiting element.

3. The connecting structure of claim 1, wherein the connecting element is symmetrical along a center axis, there are multiple pairs of recesses and corresponding openings on the connecting element, one pair or multiple pairs of recesses and corresponding openings distributed on both sides of the center axis on the connecting element, and these pairs of recesses and openings form the limiting element.

4. The connecting structure of claim 1, wherein there are multiple positioning elements and there is one limiting element, the positioning elements are disposed apart from each other along a length direction of the elastic element.

5. A trampoline comprising:

a frame;

an elastic element connected to the frame;

a jumping mat; and a connecting element connected to the jumping mat;

wherein, the elastic element has a plurality of positioning elements disposed apart from each other along a length direction of the elastic element;

the connecting element has a plurality of limiting elements disposed apart from each other along a length direction of the connecting element, for engaging one of the plurality of the positioning elements and connecting the elastic element to the connecting element;

one end of the elastic element is connected to the frame, and other end of the elastic element is connected to the limiting element on the connecting element through the positioning element;

the elastic element being an elastic rope, the plurality of positioning elements being beads which are fixed onto the elastic rope and having an external profile diameter greater than the diameter of the elastic rope;

the plurality of limiting elements being positioning boxes, each positioning box having a hollow body, a front side, and an open side; at least one limiting hole for the elastic rope to pass through is provided on the front side of the positioning box, and a diameter of the limiting hole is smaller than the external profile diameter of the bead; and an end lid, having a plurality of snaps provided on a circumference of an inner edge of the end lid, the end lid covering the open side of the hollow body; and the hollow body, the end lid, and the at least one limiting hole of the positioning box form the limiting element.

6. A connecting element in a trampoline, for connecting to an elastic element with a positioning element in the trampoline, comprising a limiting element;

wherein, the limiting element limits the positioning element and connects the elastic element to the connecting element;

the elastic element is an elastic rope, the positioning element is a bead which is fixed onto the elastic rope and has an external profile diameter greater than the diameter of the elastic rope;

the connecting element has a recess for receiving the bead, and an opening communicated with the recess for the elastic rope to pass through is provided on the connecting element, the diameter of the opening is less than that of the bead so as to position the bead, the recess has an open side, and an end lid, having a plurality of snaps provided on a circumference of an inner edge of the end lid, covers the open side of the recess;

the recess, the end lid, and the corresponding opening form said limiting element.

7. The connecting element of claim 6, wherein there are multiple pairs of recesses and corresponding openings on the connecting element, and all these pairs of recesses and openings form the limiting element.

8. The connecting element of claim 6, wherein the connecting element is in symmetrical along a center axis, there are multiple pairs of recesses and corresponding openings on the connecting element, one pair or multiple pairs of recesses and corresponding openings distributed on each of two sides of the center axis on the connecting element, and all these pairs of recesses and openings form the limiting element.

* * * * *